US006213300B1

(12) United States Patent
Flaig et al.

(10) Patent No.: US 6,213,300 B1
(45) Date of Patent: Apr. 10, 2001

(54) REFILLABLE TOWELETTE DISPENSING PACKAGE

(75) Inventors: Raymond Michael Flaig, Stamford; Josephine Telesca, Trumbull, both of CT (US)

(73) Assignee: Unilever Home & Personal Care USA, division of Conopco,Inc., Greenwich, CT (US)

( * ) Notice: Subject to any disclaimer, the term of this patent is extended or adjusted under 35 U.S.C. 154(b) by 0 days.

(21) Appl. No.: 09/566,221

(22) Filed: May 5, 2000

Related U.S. Application Data

(60) Provisional application No. 60/144,781, filed on Jul. 20, 1999.

(51) Int. Cl.[7] ..... B65D 85/62

(52) U.S. Cl. ..... 206/494; 206/233; 206/812; 221/46

(58) Field of Search ..... 206/233, 205, 206/210, 494, 499, 812; 221/44–46, 61, 64

(56) References Cited

U.S. PATENT DOCUMENTS

| | | | | |
|---|---|---|---|---|
| 3,836,045 | * | 9/1974 | Duhy et al. | 206/494 |
| 3,967,756 | * | 7/1976 | Barish | 221/45 |
| 3,979,020 | | 9/1976 | Braber et al. . | |
| 4,535,912 | * | 8/1985 | Bonk | 221/46 |
| 4,790,436 | | 12/1988 | Nakamura . | |
| 5,040,680 | * | 8/1991 | Wilson et al. | 206/494 |
| 5,379,897 | | 1/1995 | Muckenfuhs et al. . | |
| 5,531,325 | | 7/1996 | Deflander et al. . | |
| 5,647,506 | | 7/1997 | Julius . | |
| 5,699,912 | * | 12/1997 | Ishikawa et al. | 206/494 |

FOREIGN PATENT DOCUMENTS 0 744 357 5/1995 (EP) .

OTHER PUBLICATIONS

Photocopy of Kao Biore Carton—1969.
Photocopy of Silcott Carton—1999.

* cited by examiner

*Primary Examiner*—Luan K. Bui
(74) *Attorney, Agent, or Firm*—Milton L. Honig

(57) ABSTRACT

A towelette product is provided which includes a stack of flexible towelettes, a refill package for storing the towelettes and a cover housing surrounding the refill package. The refill package has deck and floor walls in parallel relationship to one another. An aperture in the deck allows access and egress of individual towelettes and is circumscribed by a rigid mouth with a coupling structure. The cover housing is formed with a roof on an upper surface and an open mouth along a lower edge. A dispensing port of the roof is defined by a rigid engagement wall directed downward toward the open mouth and engageable with the coupling structure of the rigid mouth in a sealable relationship to prevent moisture from transferring therebetween. Only a single seal is necessary to both join together refill and cover housing and serve as a towelette dispensing orifice.

10 Claims, 1 Drawing Sheet

REFILLABLE TOWELETTE DISPENSING PACKAGE

This application claims the benefit of U.S. Provisional application Ser. No. 60/144,781, filed Jul. 20, 1999.

BACKGROUND OF THE INVENTION

1. Field of the Invention

The invention concerns a towelette product and a refill package for dispensing towelettes.

2. The Related Art

Chemically impregnated pads, sheets and tissues (collectively defined as towelettes) are established articles of commerce. They are generally utilized for personal hygiene, cosmetic purposes and household cleaning applications. Fluid impregnated towelettes require packaging which avoids evaporation of solvents. Dry towelettes impregnated with dry chemical coatings (e.g. surfactant compositions) require exclusion of atmospheric moisture during storage periods. Problems arise where a stack of impregnated towelettes are packed together in a common container. Dispensing of a single item requires resealability of the container to prevent the articles from either drying out or absorbing unwanted moisture. Notable advances in the art include the following disclosures.

U.S. Pat. No. 5,647,506 (Julius) describes a resealable dispenser for delivering interleaved, individual moisture-impregnated tissues from a housing having sufficient rigidity to retain its shape subsequent to its manufacture. A top wall includes a recess portion provided with an orifice for removing individual tissues from the housing. A resealable flexible label is attached to the outer surface of the top wall and completely covers the recessed portion. In one alternative embodiment, a bottom of the dispenser is provided with a bottom sheet optionally formed of one or more layers of thin synthetic resin film.

U.S. Pat. No. 5,379,897 (Muckenfuhs et al.) discloses a disposable, compactable package for delivering a stack of tissues. The package may be produced as a thermoform. A tabbed resealable label is secured over a bottom area of the package.

U.S. Pat. No. 4,790,436 (Nakamura) discloses a resealable dispenser-container for wet tissues. A deformable pouch containing a stack of the tissues is held rigid with the assistance of a shape maintaining member even after most of the tissues have been dispensed. Suitable shape maintaining members include an outer box surrounding the pouch fixed with an adhesive on an undersurface of the box roof which prevents pouch wall collapse. A second embodiment is a U-shaped frame inserted within the pouch. Both of these solutions present either cost or manufacturing difficulties.

U.S. Pat. No. 5,531,325 (Deflander et al.) describes a pouch for storing interleaved tissues with a resealable flap opening. The pouch is housed in a rigid outer container which in its closed position is sufficiently air-tight to prevent exchange of air between contents of the container and the outside atmosphere. An anti-slip member such as a glue strip is attached to the pouch and projects through a hole in the bottom of the container to prevent the latter from slipping on a support surface. The air-tight outer container requires considerable plastic material in its construction. Not only is the container heavy but the relatively large amount of plastic presents an environmental disposal issue.

Commercial expressions of towelette packaging art include a Kao Biore® dispenser of fluid impregnated tissues. An outer relatively rigid case surrounds a relatively soft refill pack of tissues within a flexible foil package. The outer case has a cover portion with top and side walls while a bottom wall is sealably/replaceably snapped onto the underside of the cover. An aperture for dispensing towelettes and hinged lid is constructed in the top wall of the upper cover. Evaporation of moisture requires a tight seal between side walls and bottom wall as well as a sufficient friction seal of the lid against the aperture. It is not always easy to ensure that both types of seals are sufficiently tight. Most especially, the floor wall because of its relatively large sealing perimeter requires great care in closure with the bottom edge of the side walls. A related package with similar structural problems is also commercially in the Japanese market sold under the Silcot trademark.

Evident from the foregoing selection of technology is the need for improved, more efficient mechanisms for ensuring good seals to prevent moisture or solvents from transferring in either direction through the seals.

Accordingly, it is an object of the present invention to provide a towelette product which can maintain a stack of towelettes hermetically sealed from the atmosphere during extended storage periods, especially after multiple openings for dispensing of individual tissues.

It is a further object of the present invention to provide a towelette product which after having dispensed most of a stack of towelettes is substantially as efficiently resealable as in its initial fully towelette filled position.

Another object of the present invention is to provide a towelette product in refill form wherein the refill is sufficiently sturdy to stand alone on store shelves without further wrapping such as within a carton.

SUMMARY OF THE INVENTION

A towelette product is provided which includes:

a stack of flexible towelettes;

a refill package containing the stack of towelettes, the package having walls forming a deck and a floor on respective upper and lower faces in parallel relation to one another, the deck including an aperture allowing access and egress to the stack of towelettes, the aperture being circumscribed by a rigid mouth with a coupling structure; and a cover housing having an internal cavity, the housing forming a roof on an upper surface and an open mouth along a lower edge opposite the roof, the roof including a dispensing port with a rigid engagement wall defining the dispensing port, the rigid engagement wall being directed downward toward the open mouth and engageable with the coupling structure of the rigid mouth in sealable relationship to prevent moisture from transferring through the sealable relationship.

The floor of the refill package preferably is of cellulosic board construction, especially a laminate board. Alternatively but less preferably, the floor may be formed of a foil of plastic material such as a polyester, polyamide or polyolefin as well as any aluminized foil. Side walls are normally present in the refill which join deck and floor walls along edges of the side walls. The floor can extend beyond the edges of the side walls forming a perimeter flange, the flange abutting the lower edge of the open mouth of the housing.

A lid hingedly connected to the deck of the cover housing can be provided for sealably engaging in a closed position within the dispensing port. Advantageously the walls other than the floor of the refill package may be injection molded, particularly as a thermoformed article. An injection molding process may also deliver the cover housing. The latter may be constructed of materials more rigid than that forming the refill package. A hard cover housing along with the coupling structure to the deck of the refill package ensure not only a good seal but also prevent against refill package collapse as towelettes are emptied therefrom.

BRIEF DESCRIPTION OF THE DRAWING

Further objects, features and advantages of the present invention will become more evident from consideration of the following drawing in which.

DETAILED DESCRIPTION OF THE INVENTION

Now it has been discovered that a refillable towelette product dispenser can be provided with but a single seal connection. Vapor loss is controllable to a high degree by the improved configuration. A single seal for the dispenser system is achieved by a rigid engagement wall around the dispensing port of a cover housing sealably coupling with a rigid mouth aperture of a refill package. Not only is the refill and housing sealed but these components are also held together against separation.

Figure 1:
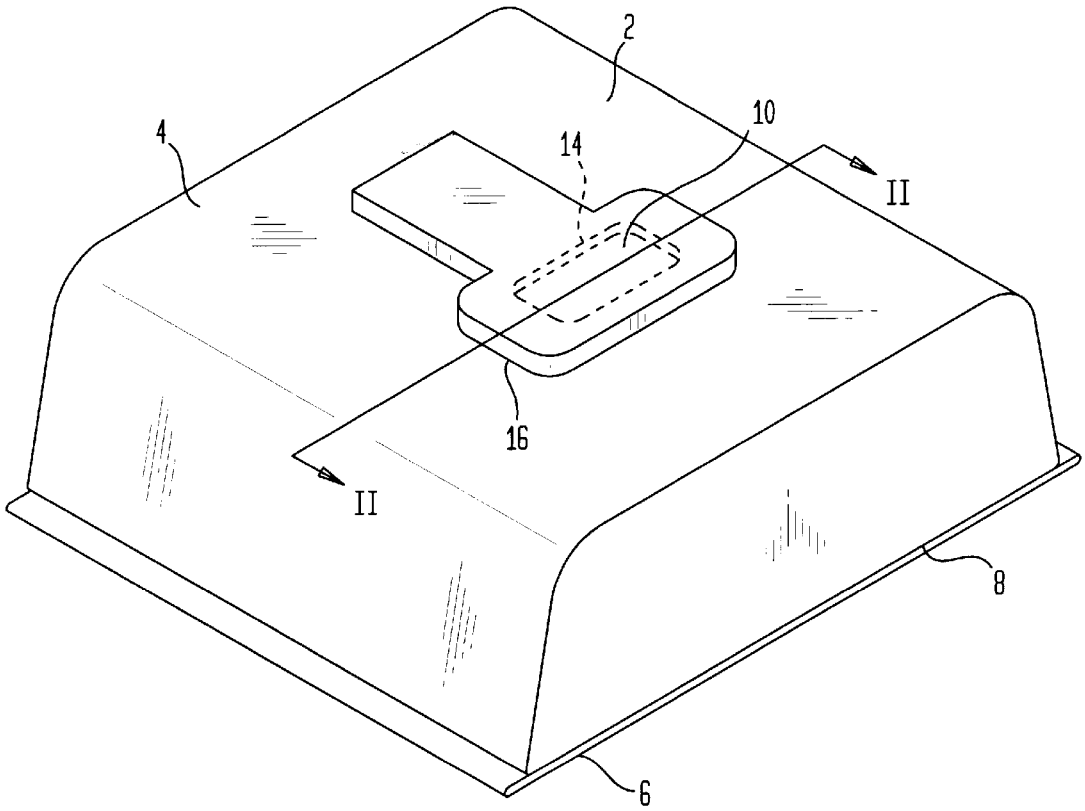
FIG. 1 is a plan perspective view of one embodiment according to the present invention.
Figure 2:
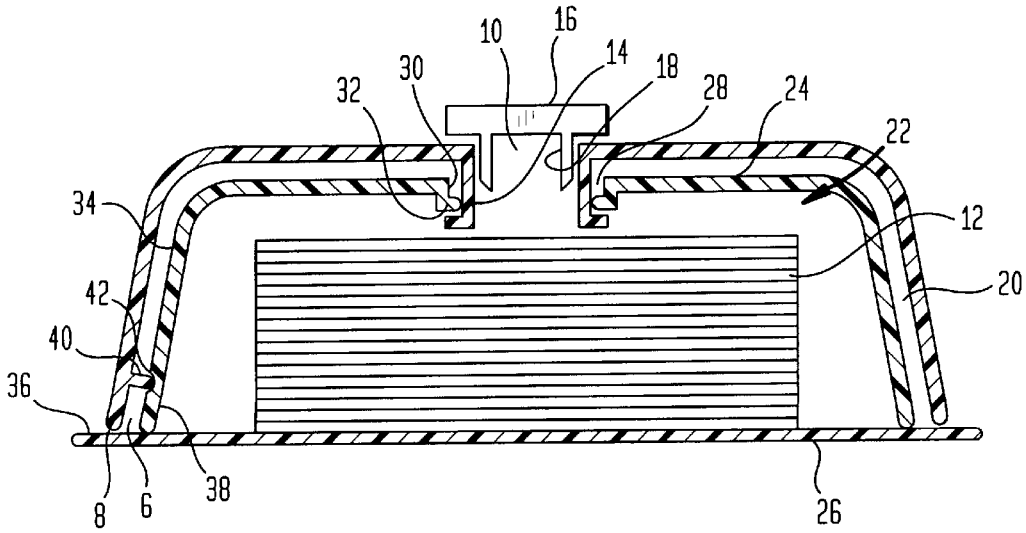
FIG. 2 is a cross-sectional view along line II—II of FIG. 1.

FIG. 1 illustrates a towelette product including a cover housing 2 formed with a roof 4 on an upper surface and an open mouth 6 defined by lower edges 8 of the housing which is opposite the roof. A dispensing port 10 traverses the roof allowing dispensing of individual towelettes from a stack of towelettes 12. A rigid engagement wall 14 defines the dispensing opening and is directed downward toward open mouth 6. Closure of the dispensing port is achieved with a lid 16 hingedly connected to the roof. In its closed position, the lid is engageable within the dispensing port through a friction fit between a valve fitment 18 of the lid and the rigid engagement wall.

An internal cavity 20 is formed within the cover housing. A refill package 22 is protectively stored within the internal cavity.

The refill package contains the stack of towelettes. The package is constituted of walls including a deck 24 and a floor 26 on respective upper and lower faces in parallel relation to one another. The deck includes an aperture 28 allowing access and egress to the stack of towelettes. A rigid mouth 30 circumscribes the aperture. A coupling structure in the form of a detent bead 32 juts inward toward a center of the rigid mouth. Many alternative coupling structures can be utilized. Engagement can be through a groove and tongue or a tapered LEUR locking arrangement preventing passage of moisture therebetween. Walls of the refill package are preferably of thermoform construction. These walls are preferably less robust than those forming the cover housing and being formed of a thinner gauge material and/or a more flexible plastic. Foil may constitute the refill package walls as alternative to the thermoform. Irrespective of the wall construction, the floor of the refill is advantageously of board-like rigidity, preferably a cellulosic board. Side walls 34 join the deck and floor. The latter extends beyond the edge of the side walls forming a perimeter flange 36. This flange abutts the lower edge 8 of the open mouth of the housing. A tight seal is achieved between flange and lower edge as a result of refill and cover housing being tightly interengaged through the rigid engagement wall and coupling structure. Especially when the walls of the refill package are of thermoform construction, it is advantageous for the floor to be heat sealed against edges 38 of the side walls.

Prior to insertion within the cover housing, the aperture of the refill package may be sealed by a removable adhesive foil.

Proper orientation is important for placement of the refill package within the internal cavity of the cover housing. Proper orientation may be achieved by complementary guide elements 40, 42 on an external wall surface of the refill package and on an internal surface wall of the cover housing, respectively. Representative guide elements include recess/projecting detent formations and interference ledges.

The foregoing description illustrates selected embodiments of the present invention. In light thereof, various modifications would be suggested to one skilled in the art, all of which are within the spirit and purview of this invention.

What is claimed is:

1. A towelette product comprising:

a stack of flexible towelettes;

a refill package containing the stack of towelettes, the package having walls forming a deck and a floor on respective upper and lower faces in parallel relation to one another, the deck including an aperture allowing access and egress to the stack of towelettes, the aperture being circumscribed by a rigid mouth with a coupling structure; and a cover housing having an internal cavity, the housing forming a roof on an upper surface and an open mouth along a lower edge opposite the roof, the roof including a dispensing port with a rigid engagement wall defining the dispensing port, the rigid engagement wall being directed downward toward the open mouth and engageable with the coupling structure of the rigid mouth in sealable relationship to prevent moisture from transferring through the sealable relationship.

2. The product according to claim 1 wherein the walls other than the floor of the refill package are of thermoformed construction.

3. The product according to claim 1 wherein the floor of the refill package is of cellulosic board construction.

4. The product according to claim 1 wherein the refill package further comprises side walls joining the deck and floor walls along edges of the side walls, the floor extending beyond the edges of the side walls to form a perimeter flange, the flange abutting the lower edge of the open mouth of the housing.

5. The product according to claim 4 wherein the flange is heat sealed to the side walls.

6. The product according to claim 1 wherein the towelettes are impregnated with a fluid composition having an evaporatable solvent.

7. The product according to claim 1 wherein the towelettes are impregnated with a dry chemical composition sensitive to being activated with moisture.

8. The product according to claim 1 wherein the cover housing further comprises a lid hingedly connected to the roof and in a closed position engageable within the dispensing port.

9. The product according to claim 1 wherein the cover housing is constructed of material more rigid than that material forming walls of the refill package.

10. The product according to claim 1 wherein the coupling structure is an interference bead projecting away from a surface of the rigid mouth.

* * * * *